United States Patent [19]

Padovani

[11] Patent Number: 4,688,714

[45] Date of Patent: Aug. 25, 1987

[54] COVER FOR EGG TRAY TO BE SHRINK WRAPPED

[75] Inventor: Pietro Padovani, Verona, Italy

[73] Assignee: Industrie Specializzate Articoli Plastici SpA, Verona, Italy

[21] Appl. No.: 640,768

[22] Filed: Aug. 14, 1984

[30] Foreign Application Priority Data

May 18, 1984 [FR] France ..... 84 07774

[51] Int. Cl.[4] ..... B65D 1/00; B65D 65/00

[52] U.S. Cl. ..... 229/2.5 EC; 206/497; 206/45.31

[58] Field of Search ..... 229/2.5 EC; 206/497, 206/45.31

[56] References Cited

U.S. PATENT DOCUMENTS 4,335,813 6/1982 Bessett et al. ..... 229/2.5 EC

FOREIGN PATENT DOCUMENTS 0557323 5/1987 Belgium ..... 229/2.5 EC
91168 3/1968 France ..... 229/2.5 EC
2519612 1/1982 France .
652471 2/1963 Italy ..... 229/2.5 EC

*Primary Examiner*—Joseph Man-Fu Moy
*Attorney, Agent, or Firm*—Ladas & Parry

[57] ABSTRACT

The object of this invention is a lid of truncated pyramidal shape made of thin transparent synthetic material to be used a-top a tray containing eggs, the object of this lid it to facilitate film wrapping of tray. Said lid is equipped with features to ease its placement on to the tray, provides for the avoidance of displacement and arching of its lateral walls during film wrapping; with features which would insure a stable and protected position of the eggs via small anti-shock air pockets; with features which would prevent the impaction of empty lids one to the other when stacked.

22 Claims, 13 Drawing Figures

FIG. 1
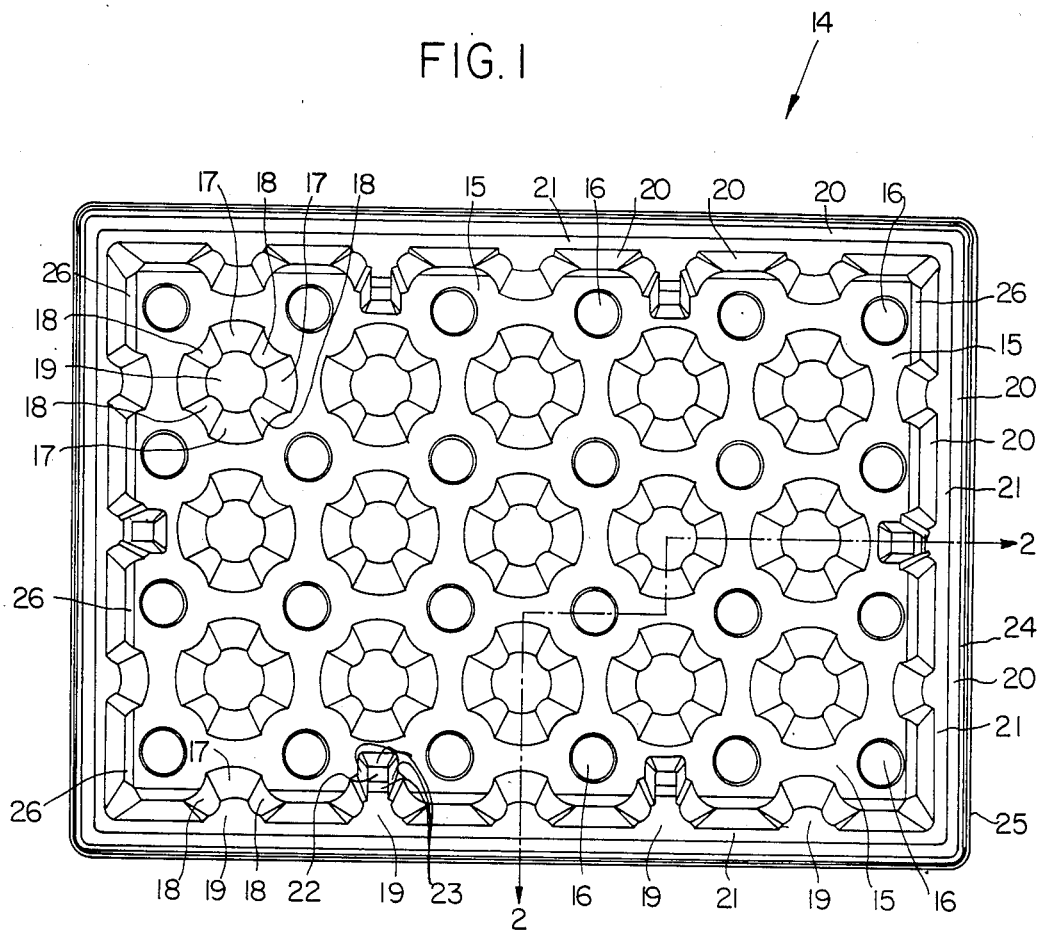
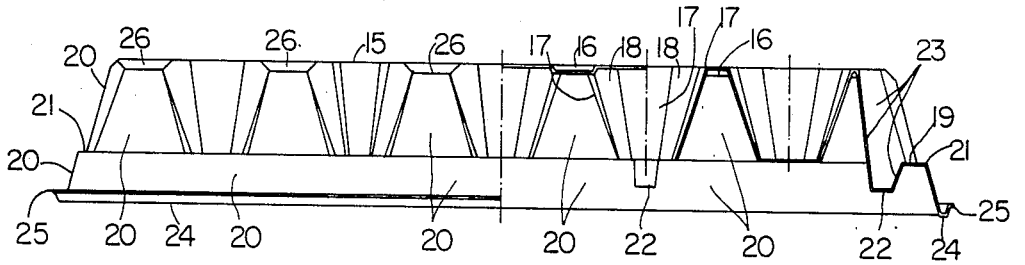
FIG. 2

FIG. 3
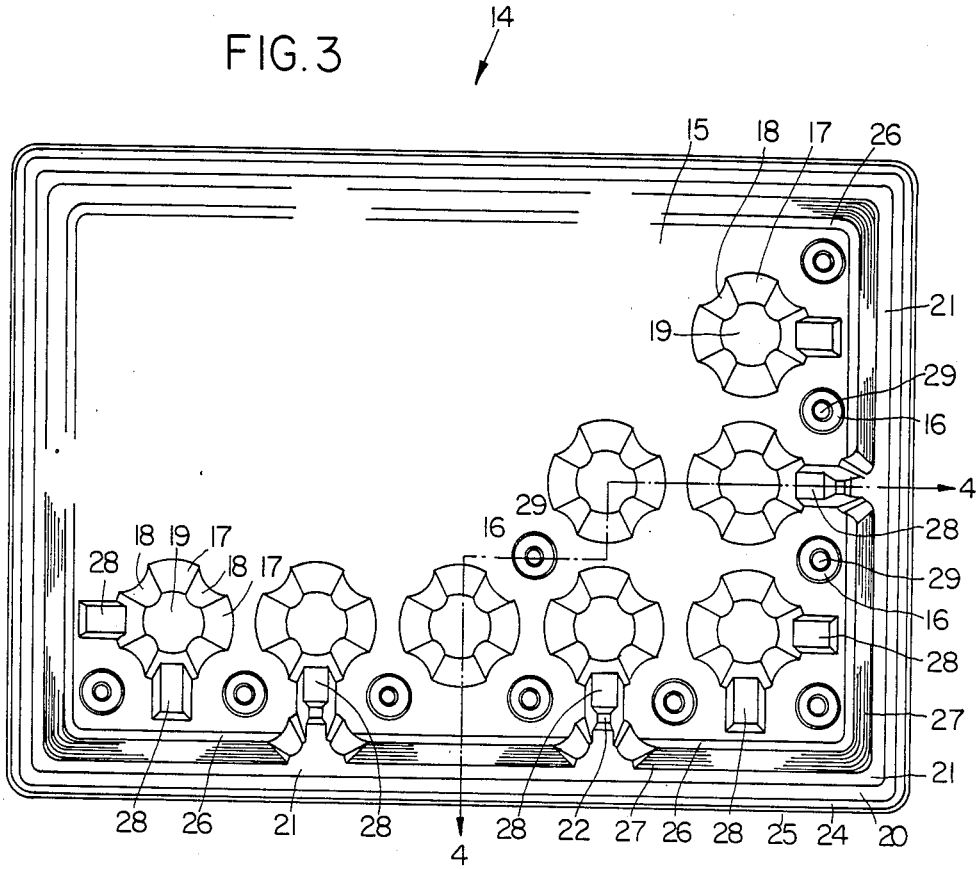
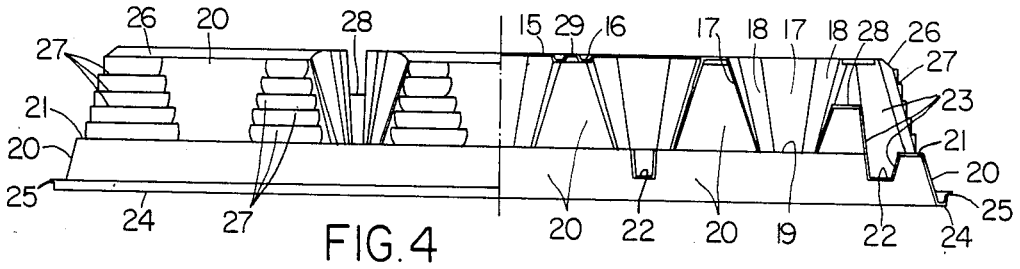
FIG. 4
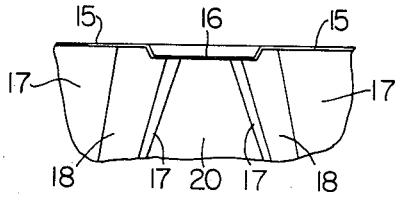
FIG. 5
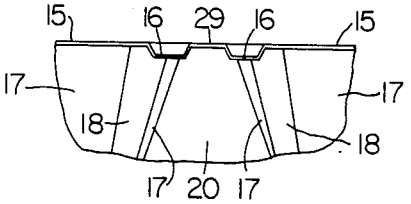
FIG. 6

FIG. 7
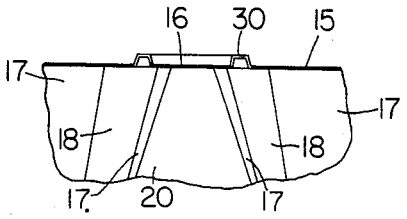
FIG. 8
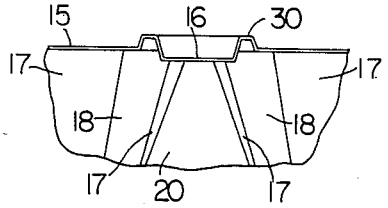
FIG. 9
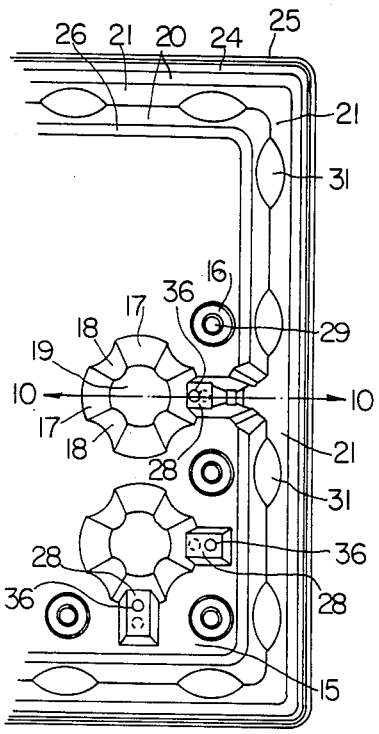
FIG. 12
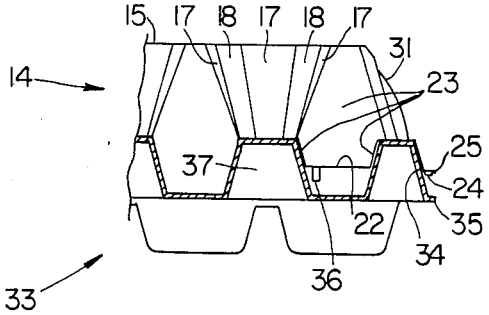
FIG. 10
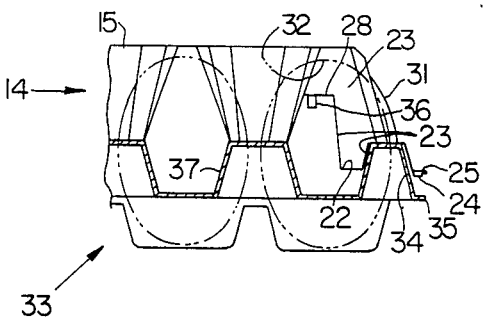
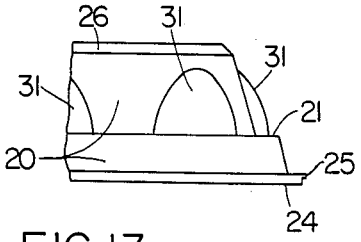
FIG. 13
FIG. 11
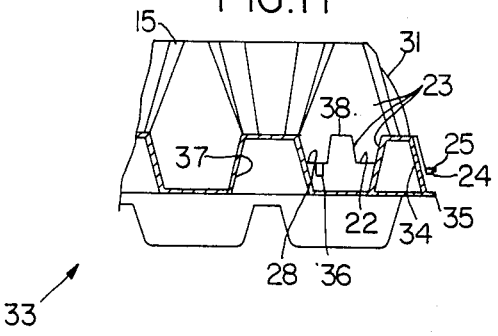

COVER FOR EGG TRAY TO BE SHRINK WRAPPED

BACKGROUND OF THE INVENTION

This is the invention of a lid of thermoplastic synthetic material, preferably transparent, to be applied a-top open egg-trays, made of card-board, wood-by-products or styrofoam and/or the like. Said trays are to contain a determined number of eggs, for example 20, 24, 30, 36 and are commonly known as egg-trays. These trays feature a number of truncated cone shaped cavities at given intervals.

These egg-trays, along their outer perimeters, feature one half cone shape and one half pyramid shaped reliefs, along with small cone and pyramidal segments at their corners.

To permit visual inspection of the eggs, and to ease manipulation in wrapping, these trays are equipped with a lid of synthetic, transparent material and are sold film-wrapped.

During film-wrapping operations, the aforementioned lids have resulted in a series of inconveniences, such as improperly mounting upon the egg-tray, arching towards the lower external lateral walls, resulting in easy breakage of the lid's border often followed by perforation of the wrapping film. It is thus noted that, in the resulting packaging, the eggs are in direct contact with the upper flat surfaces of these lids and are therefore subject to damage when the least pressure is imparted. Furthermore the stacking of the empty lids one-a-top the other results in impaction making their separation (by machine) physically impossible.

The invention's goal is the realization of a lid which eliminates the above cited problems.

SUMMARY OF THE INVENTION

The invention's goal is accomplished via a lid substantially of truncated pyramidal design with a quadrangular top-side. The lid features depressions and hollow cavities which will light upon the central and peripheral reliefs of the tray. The lid is further characterized by hollow cavities which, when coupled with the film-wrapping, provide small anti-shock air pockets and, along its lateral walls, by a rim which presses against the peripheral reliefs of the egg-tray. This rim is attached to the lid's top-side via a depression projecting beyond the tray's relief. The lower part of the lid's lateral walls is folded outward and upward with a marginal border which points towards the exterior. The invention is further characterized by the fact that the top-side of the lid, at least at its four corners and along its lateral walls, presents hollow cavities constituting reinforcements on spacers protrude inward.

BRIEF DESCRIPTION OF THE DRAWINGS

The invention will be more aptly understood via the description which follows, the description to be used in conjunction with the attached figures. These figures, variable in scale, illustrate several preferred embodiments of the aforementioned lid.

FIG. 1. is a top view of the lid.

FIG. 2. is a partial lateral cross-section of the same lid, along line 2—2 of FIG. 1).

FIG. 3. is a partial top view of an alternate embodiment of the lid.

FIG. 4. is a partial lateral cross-section of lid along line 4—4 of FIG. 3).

FIGS. 5, 6, 7, and 8. are schematic cross-sections of various hollow cavities which, when coupled with wrapping film, constitute anti-shock air pockets.

FIG. 9. is a partial top view of a second embodiment of the lid set upon an egg-tray.

FIG. 10. is a cross-section of lid and tray along line 10—10 of FIG. 9).

FIGS. 11 and 12. depict two cross-sections—similar to that in FIG. 10—of two of the retentive depressions of the lid.

FIG. 13. is a partial lateral view of the lid of FIG. 9), inproximity of a corner of the same.

DETAILED DESCRIPTION OF THE PREFERRED EMBODIMENT

It is to be remembered that, in these illustrations, the same numbers correspond to equal or equivalent parts.

With reference to FIGS. 1 and 2, it shoud be noted that lid 14 is, for the most part, characterized by a truncated pyramidal shape; its top-side 15, though rectangular in form, features cone shaped cavities 16. With the wrapping film the anti-shock air pockets are found between the edges of the eggs and the lid's surface. (Note: neither tray, nor wrapping film are here illustrated.)

It is clear and evident that the cone shaped cavities 16, may in practice be rendered with a pyramidal shape without in any way changing the essential characteristics of the invention.

On the surface 15 between the caivites 16 are illustrated cone shaped depressions 17 with inward arching walls 18 which converge toward the bases 19.

On the lid's lateral wall 20 there is provided a rim 21 which extends at the same level of the bases 19, so that, when lid 14 is set upon the egg-tray, the lowest parts rest on the tray's lateral reliefs. On the lid's lateral sides, one notes several indentations. These indentations, corresponding to one-half of the cone shaped depressions 17, 18, 19 and, in conjunction with their bases, determine the expansion of the rim 21 towards the center of the lid. These expansions are joined to the top-side (15) via walls of cone configuration, corresponding to those of cone shaped depressions 17, 18, 19.

Some of the rim's 21 expansions are joined to the top-side 15 and the lateral walls 24 of lid 14 via pyramidal depressions 22. All of the expansions of the rim may be joined via the aforementioned method without changing, in any way or form, the effectiveness of this invention.

The pyramidal depressions 22, 23, are guide elements, which in conjunction with the lateral wall 20 of the lid, below the rim 21, allow for proper placement of the lid 14 upon the egg-tray and prevent any movement of the lid during film wrapping and packaging operations. Due to the fact that they rest each upon the lateral walls of the outer reliefs of the tray, these depressions prevent arching of the other lateral wall 20 of lid during film wrapping, and are strengthened by the corners which the rim 21 forms with the lateral wall 20 and by the inferior part of the lateral wall folded up-ward and outward to form an exterior facing reinforcement groove 24.

The outer portion of lateral wall 20 in its straight-line segments is linked to the top-side 15 via rounded corners 26 and, it is obvious that, even though not illustrated in the designs, the corners which exist between top-side 15 and the depressions in the lateral wall 20 of the lid, may also be rounded to avoid perforation of the filming material.

The lid illustrated in FIGS. 3 and 4 differs from that described in FIGS. 1 and 2 by the fact that lateral wall 20 above the rim 21, has long straight-line segments provided with reinforcement ribbon which wrap around lid's four corners and run parallel to the rim 21. In this example, the expansions towards the interior of the rim 21 are limited to those linked to the pyramidal depressions 22, 23, and to the top-side 15 of the lid, while reinforcement grooves at the base 28 connect the pyramidal depressions 22, 23, to the corresponding facing cone shaped depressions 17, 18, 19. Similar reinforcement grooves 28, are also provided—for reasons previously outlined—between the cone shaped depressions 17, 18, 19 at the four corners of the lid's superior and inferior (upper/lower) sides.

Furthermore, the truncated cone shaped cavities 16 which, coupled with the filming membrane, define the anti-shock air pockets, have been designed with a truncated cone shaped relief 29 producing, in this case, circular shaped air pockets; see the detailed illustration in FIG. 6. The structure which defines these air pockets, in turn protects the upper-most edge of the eggs housed in the tray from being damaged (e.g. reduces breakage) therefore the circular design of these air pockets has, in practice, demonstrated itself to be far more effective than the single pocket design obtained by using the cone shaped cavity 16 illustrated in FIG. 5.

FIG. 7 illustrates an alternate embodiment of the cone shaped cavity 16, obtained with a circular relief 30 projecting from the lid's top-side 15. FIG. 8 shows the truncated cone shaped cavity 16 of FIG. 5, joined to the lid's top-side 15 via circular relief 30 very similar to the one illustrated in FIG. 7.

The lid illustrated in FIGS. 9 and 10 respectively, sports a wider rim 21 than the corresponding rim of FIGS. 1 to 4. Thusly, on the lateral wall 20 and in the surface directly above the rim 21, it was structurally necessary to add spheroid projections 31 for proper housing of the eggs 32 arranged in the tray 33 made of wood-by-products, card-board and the like.

The aforementioned spheroid projections 31 are responsible for a reduction in the width of the rim 21 along those segments between the perimetral projections 34 of the container 33, a container which is provided with a laminated border 35 a set distance from border 25 and groove 24 of lid 14, set atop tray 33, for sucessive film wrapping, as clearly demonstrated in FIGS. 10–12.

From the base cavities 28 of the reinforcement grooving, protrude hollow cylindrical spaces 36—see FIGS. 9 and 10—with the express purpose of preventing the lid's impaction when these are stacked one atop the other.

In FIG. 11 it is noted that the base cavities 28 of the reinforcement grooving, connecting the pyramidal depression 22, 23 to truncated cone shaped depression 17, 18, 19, were raised to the same level as the bottoms of the pyramidal depressions 22, 23 creating a second base cavity 28 separated from the previous one via divider 38 to press against the lateral wall of lower relief 37 proximal to the perimetral relief 34. All this is done, with the explicit purpose of preventing any shifting between the lid 14 and the container 33 during film wrapping.

In FIG. 12 the divider 38 of FIG. 11 is not provided thus the only depressions 22, 23, are of such dimensions as to press against both the lateral walls of the perimetral relief 34 as well as those of the interior 37, again with the explicit purpose of preventing any and all shifting between the lid 14 and container 33 during film wrapping operations.

The invention is not limited to the precise constructional details set forth above.

I claim:

1. A lid to facilitate film wrapping of an open egg container, said lid being essentially of truncated pyramidal shape with a quadrangular top surface (15), in which is formed cone-shaped depressions (17), (18), (19) and having lateral walls (20), in which are formed grooves, each corresponding to a depression (17), (18), (19), said grooves and depressions, in use, being mounted upon internal and peripheral reliefs (37) and (34), respectively, of said container (33); said lead further including; recesses (16), (29), (30), which provide, in combination with the film wrapping, anti-shock pockets; a continuous rim (21) disposed about the quadrangular top surface, said rim, in use, being partially mounted upon the peripheral relief (34), said rim including at least one expansion on each side of the rim, each expansion being disposed towards the interior of the lid, and joined to the top surface (15) thereof via additional depressions (22), (23); and a reinforcement groove (24) with a marginal border (25), said groove being disposed at a lower part of the lateral wall (20); said top surface (15), further including cavities (28) defining reinforcement ribbing from which spacers (36) project toward the interior; said expansion, additional depression, rim, groove and border of the lid interacting with the container to reduce arching and breaking of the lateral walls during film wrapping.

2. The lid as in claim 1, in which each recess (16) is of truncated cone shape diverging towards the top surface (15).

3. The lid as in claim 1, in which each recess (16) is formed by a circular shaped relief (30) projecting from top surface (15).

4. The lid as in claim 2, in which each recess (16) is joined to top surface (15) via circular shaped relief (30).

5. The lid as in claim 1, in which each recess (16) comprises a truncated central cone shaped relief (29) equivalent in height to the depth or recess (16).

6. The lid as in claim 1, in which the lateral wall (20), above the rim (21) is provided with reinforcement ribbing (27) extending parallel to rim (21), at least in the area around the four corners of lid (14).

7. The lid as in claim 1, in which the lateral wall (20), above the rim (21) is provided with sphere shaped projections (31).

8. The lid as in claim 1, in which the cavities (28) are spaced from additional depressions (22), (23), and separated therefrom by a divider in (38).

9. The lid as in claim 1, in which the cavities (28) are integral with additional depressions (22), (23) to form a single depression between internal and peripheral reliefs (37) and (34) of container (33).

10. A lid for use in combination with an egg tray, the tray and lid forming an egg container adapted to be film wrapped, the lid comprising: a top surface having depending side walls, the top surface and side walls defining a frusto-conical shaped hollow lid; a plurality of cone shaped depressions extending inwardly from the top surface, wherein a portion of an egg, in use, is located between two or more depressions; a plurality of recesses interjacent the depressions, the recesses projecting inwardly from the top surface, each recess being located substantially over the top of an egg in the tray, the film wrapping and each recess defining an airtight pocket over an egg to provide a shock absorber to protect the egg from breakage; and at least one guide element along each side wall of the container, a guide element comprising an expansion member extending inwardly from the side wall, each expansion member having a depression therein, the expansion and depression interacting with the tray to reduce arching and breaking of the side walls during film wrapping.

11. A lid as claimed in claim 10 wherein each side wall comprises an upper portion, a lower portion, and a rim between the upper and lower portions.

12. A lid as claimed in claim 11 further comprising an expansion member extending inwardly from the rim, each expansion member having a downwardly projecting portion which is adapted to mount on the tray, and walls connecting the downwardly projecting portion with the top surface.

13. A lid as claimed in claim 11 wherein the lower portion of the side wall comprises a marginal border, and a groove defined by the marginal border.

14. A lid as claimed in claim 10 wherein each recess is a circular shaped relief projecting inwardly from the top surface.

15. A lid as claimed in claim 10 wherein each recess comprises a circular shaped relief extending inwardly, the recess having an upwardly extending projection therein, the projection being flush with the top surface.

16. A lid as claimed in claim 10 wherein the upper portion of the side wall is provided with reinforcement ribbing.

17. A lid as claimed in claim 16 wherein the reinforcement ribbing is provided only at corners of the lid.

18. A lid as claimed in claim 11 wherein the rim is broad and sphere shaped outward projections are provided on the upper portion of the side wall to accommodate eggs within the lid.

19. A lid as claimed in claim 12 further comprising reinforcement cavities having walls adapted to mount on the tray of the container.

20. A lid as claimed in claim 19 wherein the reinforcement cavities are adjacent the downwardly projecting portion of the expansion means, and separated therefrom by a divider.

21. A lid as claimed in claim 20 wherein each cavity has a downwardly projecting spacer.

22. A lid as claimed in claim 19 wherein each reinforcement cavity is integral with the downwardly projecting portion of the expansion member.

* * * * *